US009945010B2

(12) United States Patent
Danielou et al.

(10) Patent No.: US 9,945,010 B2
(45) Date of Patent: Apr. 17, 2018

(54) ALUMINUM-COPPER-LITHIUM ALLOY WITH IMPROVED IMPACT RESISTANCE

(71) Applicant: Constellium France, Paris (FR)

(72) Inventors: Armelle Danielou, Les Echelles (FR); Mathieu Marquette, Angers (FR); Jerome Pignatel, La Chapelle sur Erdre (FR); Gaelle Pouget, Grenoble (FR); Timothy Warner, Voreppe (FR)

(73) Assignee: CONSTELLIUM ISSOIRE, Issoire (FR)

( * ) Notice: Subject to any disclaimer, the term of this patent is extended or adjusted under 35 U.S.C. 154(b) by 669 days.

(21) Appl. No.: 13/802,280

(22) Filed: Mar. 13, 2013

(65) Prior Publication Data

US 2013/0269840 A1 Oct. 17, 2013

Related U.S. Application Data

(60) Provisional application No. 61/622,774, filed on Apr. 11, 2012.

(30) Foreign Application Priority Data

Apr. 11, 2012 (FR) ..... 12 01063

(51) Int. Cl.

| | |
|---|---|
| ***C22C 21/16*** | (2006.01) |
| ***C22F 1/057*** | (2006.01) |
| ***B21C 23/00*** | (2006.01) |
| ***C22C 21/12*** | (2006.01) |
| ***B21C 23/14*** | (2006.01) |
| ***B21C 35/02*** | (2006.01) |
| ***B21C 29/00*** | (2006.01) |

(52) U.S. Cl.

CPC ..... *C22C 21/16* (2013.01); *B21C 23/002* (2013.01); *B21C 23/142* (2013.01); *B21C 29/003* (2013.01); *B21C 35/023* (2013.01); *C22C 21/12* (2013.01); *C22F 1/057* (2013.01); *Y10T 428/12* (2015.01)

(58) Field of Classification Search

CPC ..... C22C 21/00; C22C 21/12; C22C 21/14; C22C 21/16; C22C 21/18

See application file for complete search history.

(56) References Cited

U.S. PATENT DOCUMENTS

| | | | |
|---|---|---|---|
| 5,032,359 | A | 7/1991 | Pickens et al. |
| 5,455,003 | A | 10/1995 | Pickens et al. |
| 7,229,509 | B2 | 6/2007 | Cho |
| 7,438,772 | B2 | 10/2008 | Rioja et al. |
| 2009/0142222 | A1 | 6/2009 | Colvin et al. |

FOREIGN PATENT DOCUMENTS

| | | | |
|---|---|---|---|
| WO | 2009036953 | A1 | 3/2009 |
| WO | 2012085359 | A2 | 6/2012 |
| WO | 2012085359 | A3 | 6/2012 |

OTHER PUBLICATIONS

Eberl et al., "Friction stir welding dissimilar alloys for tailoring properties of aerosapce parts", Scinece and Technology of Welding and Joining, Institute of Materials Minerals and Mining, London, GB, vol. 15, No. 8, pp. 699-705, Jan. 1, 2010, XP008159131.

Hatch et al., "Aluminium, Properties and Physical Metallurgy passage", Aluminum., Properties and Physical Metallurge, Ohio, American Society for Metals, US, pp. 224-241, Jan. 1, 1987, XP002441131.

French Search Report and Opinion from French Priority Application No. 1201063 dated Jan. 9, 2013 (8 pages).

*Primary Examiner* — Roy V King
*Assistant Examiner* — Jophy S. Koshy
(74) *Attorney, Agent, or Firm* — McBee Moore Woodward & Vanik IP, LLC; Susan E. Shaw McBee; David Vanik

(57) ABSTRACT

An extruded product made of an alloy containing aluminum comprising 4.2 wt % to 4.8 wt % of Cu, 0.9 wt % to 1.1 wt % of Li, 0.15 wt % to 0.25 wt % of Ag, 0.2 wt % to 0.6 wt % of Mg, 0.07 wt % to 0.15 wt % of Zr, 0.2 wt % to 0.6 wt % of Mn, 0.01 wt % to 0.15 wt % of Ti, a quantity of Zn less than 0.2 wt %, a quantity of Fe and Si less than or equal to 0.1 wt % each, and unavoidable impurities with a content less than or equal to 0.05 wt % each and 0.15 wt % in total is disclosed. The profiles according to the invention are particularly useful as fuselage stiffeners or stringers, circumferential frames, wing stiffeners, floor beams or profiles, or seat tracks, notably owing to their improved properties in relation to those of known products, in particular in terms of energy absorption during an impact, static mechanical strength and corrosion resistance properties and their low density.

16 Claims, 2 Drawing Sheets

ALUMINUM-COPPER-LITHIUM ALLOY WITH IMPROVED IMPACT RESISTANCE

CROSS REFERENCE TO RELATED APPLICATIONS

This application claims the priority to French Application No. 1201063, filed Apr. 11, 2012, and U.S. Provisional Application No. 61/622,774, filed Apr. 11, 2012, the contents of both of which are incorporated herein by reference in their entireties.

BACKGROUND

Field of the Invention

The invention relates to extruded aluminum-copper-lithium alloy products, and more particularly to such products, their manufacturing processes and use, notably designed for aeronautical and aerospace engineering.

Description of Related Art

Extruded products made of aluminum alloy are developed to produce high strength parts designed for the aeronautical and aerospace industry in particular.

Extruded products made of aluminum alloy are used in the aeronautic industry for numerous applications, such as fuselage stringers and stiffeners, circumferential frames, wing stiffeners, floor beams or profiles and seat tracks.

The progressive incorporation of more composite materials in aeronautical structures has modified the requirements regarding extruded products incorporated in aircraft, notably for structural elements such as floor beams. It was found that the energy absorption during an impact, or more particularly in a crash, is now a major criterion in the selection of this product. Other important properties are the highest mechanical characteristics possible, in order to reduce structural weights and corrosion resistance.

A quantity such as the specific energy absorption capacity may be used to characterize energy absorption during an impact.

The specific energy absorption capacity during an impact may be measured during a crushing test in which the force supplied is measured according to the displacement produced during the crushing. This is the amount of energy expended to crush a unit mass of material in the stable crushing phase. Ductile aluminum alloys have a high capacity to absorb energy upon impact, particularly as they deform plastically. As an initial approximation, the specific energy absorption capacity during an impact of a profile made of aluminum alloy can be associated with the curve obtained during a tensile test of the material concerned, particularly in the area below the force-deformation curve. It can therefore be evaluated by the product Rm×E % or Rp0.2×E % in the L-direction and in the LT-direction.

Al—Cu—Li alloys are known.

U.S. Pat. No. 5,032,359 describes a vast family of aluminum-copper-lithium alloys in which the addition of magnesium and silver, in particular between 0.3 and 0.5 percent by weight, makes it possible to increase the mechanical strength.

U.S. Pat. No. 5,455,003 describes a process for manufacturing Al—Cu—Li alloys that have improved mechanical strength and toughness at cryogenic temperature, in particular owing to appropriate strain hardening and aging. This patent particularly recommends the composition, expressed as a percentage by weight, Cu=3.0-4.5, Li=0.7-1.1. Ag=0-0.6, Mg=0.3-0.6 and Zn=0-0.75.

U.S. Pat. No. 7,438,772 describes alloys including, expressed as a percentage by weight, Cu: 3-5, Mg: 0.5-2, Li: 0.01-0.9 and discourages the use of higher lithium content because of a reduction in the balance between toughness and mechanical strength.

U.S. Pat. No. 7,229,509 describes an alloy including (wt %): (2.5-5.5) Cu, (0.1-2.5) Li, (0.2-1.0) Mg, (0.2-0.8) Ag, (0.2-0.8) Mn, 0.4 max Zr or other grain-refining agents such as Cr, Ti, Hf, Sc, and V.

US patent application 2009/142222 A1 describes alloys including (as a percentage by weight), 3.4 wt % to 4.2 wt % Cu, 0.9 wt % to 1.4 wt % Li, 0.3 wt % to 0.7 wt % Ag, 0.1 wt % to 0.6 wt %, Mg, 0.2 wt % to 0.8 wt % Zn, 0.1 wt % to 0.6 wt % Mn and 0.01 wt % to 0.6 wt % of at least one element for controlling the granular structure. This application also describes a process for manufacturing extruded products.

There exists a need for extruded products made of aluminum-copper-lithium alloy presenting improved properties as compared with those of known products, particularly in terms of energy absorption during an impact, static mechanical strength and corrosion resistance properties, while being of low density. Simultaneously, satisfactory toughness must be maintained for these products.

SUMMARY

A first subject of the invention is an extruded product made of an alloy containing aluminum comprising 4.2 wt % to 4.8 wt % of Cu,
0.9 wt % to 1.1 wt % of Li,
0.15 wt % to 0.25 wt % of Ag,
0.2 wt % to 0.6 wt % of Mg,
0.07 wt % to 0.15 wt % of Zr,
0.2 wt % to 0.6 wt % of Mn,
0.01 wt % to 0.15 wt % of Ti,
a quantity of Zn less than 0.2 wt %, a quantity of Fe and Si each less than or equal to 0.1 wt %, and inevitable impurities each with a content less than or equal to 0.05 wt % and 0.15 wt % in total.

Another subject of the invention is a process for manufacturing an extruded product according to the invention wherein:

(a) the rough form is cast in an alloy according to the invention,
(b) said rough form is homogenized at a temperature of 490° C. to 520° C. for 8 to 48 hours,
(c) said rough form is hot worked by extrusion at an initial hot working temperature of 420° C. to 480° C. to obtain an extruded product,
(d) said extruded product undergoes solution heat treatment at a temperature of 500° C. to 520° C. for 15 minutes to 8 hours,
(e) quenching,
(f) said extruded product undergoes controlled stretching with a permanent set of 2 wt % to 4 wt %,
(g) optionally, said extruded product is straightened,
(h) said extruded product is aged by heating at a temperature of 100° C. to 170° C. for 5 to 100 hours.

Yet another subject of the invention is the use of a product according to the invention for aeronautic construction as a fuselage stiffener or stringer, circumferential frame, wing stiffener, floor profile or beam or seat track.

DETAILED DESCRIPTION OF A PREFERRED EMBODIMENT

Figure 1:
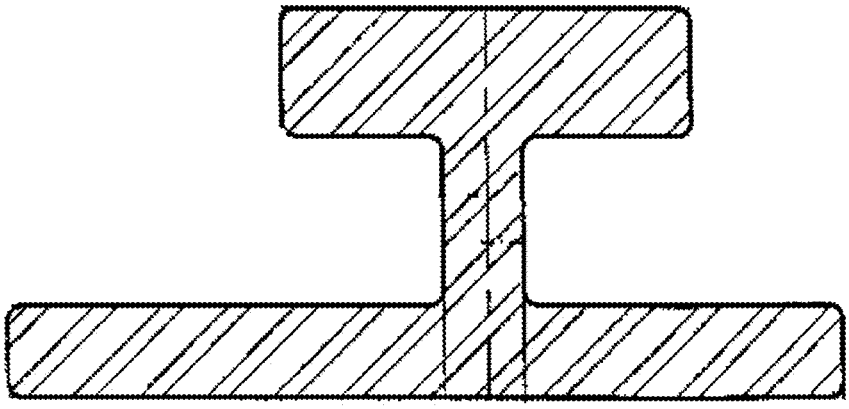
FIG. 1: Sectional view of the extruded product of example 1.

Unless otherwise stated, all the indications concerning the chemical composition of the alloys are expressed as a percentage by weight based on the total weight of the alloy. The expression 1.4 Cu means that the copper content expressed as a percentage by weight is multiplied by 1.4. Alloys are designated in conformity with the rules of The Aluminium Association, known to those skilled in the art. The density depends on the composition and is determined by calculation rather than by a method of weight measurement.

The values are calculated in compliance with the procedure of The Aluminium Association, which is described on pages 2-12 and 2-13 of "Aluminum Standards and Data". The definitions of the metallurgical tempers are indicated in European standard EN 515.

The static mechanical properties under stretching, in other words the ultimate tensile strength Rm, the conventional tensile yield stress at 0.2 wt % offset (Rp0.2) and elongation at break E %, are determined by a tensile test according to standard NF EN ISO 6892-1, and sampling and test direction being defined by standard EN 485-1.

The stress intensity factor (KQ) is determined according to standard ASTM E399. Standard ASTM E399 gives the criteria which make it possible to determine whether KQ is a valid value of K1C. For a given test specimen geometry, the values of KQ obtained for various materials are comparable with each other insofar as the tensile yield stresses of the material are of the same order of magnitude.

Unless otherwise specified, the definitions of standard EN 12258 apply.

The thickness of the extruded products is defined according to standard EN 2066:2001: the cross-section is divided into elementary rectangles of dimensions A and B; A always being the largest dimension of the elementary rectangle and B being regarded as the thickness of the elementary rectangle. The bottom is the elementary rectangle with the largest dimension A.

According to the present invention, a selected class of aluminum-copper-lithium alloys makes it possible to manufacture extruded products presenting improved properties as compared with those of known products, particularly in terms of energy absorption during an impact, static mechanical strength and corrosion resistance properties and having low density.

The simultaneous addition of manganese, titanium, zirconium, magnesium and silver, makes it possible, for selected copper and lithium contents, to achieve a compromise between a representative parameter of the energy absorption during an impact and the particularly advantageous tensile yield stress.

The copper content is generally at least 4.2 wt %, preferably at least 4.3 wt % and preferably at least 4.35 wt %. In an embodiment of the invention the copper content is at least 4.50 wt. %. The copper content is generally at the most 4.8 wt % and preferably at the most 4.7 wt % and more preferably 4.55 wt %. The selected copper notably improves the static mechanical properties. However, a high copper content may be unfavorable for the density of the alloy in many embodiments.

The lithium content is generally at least 0.9 wt % and preferably at least 0.95 wt %. The lithium content is generally at most 1.1 wt % and preferably at most 1.05 wt %. In an embodiment of the invention the lithium content is at most 1.04 wt. %. The selected lithium content range of the present invention notably improves energy absorption during an impact. However, a lithium content that is too low may be unfavorable for the density of the alloy.

The addition of manganese is an important aspect of the present invention. The manganese content is typically at least 0.2 wt % and preferably at least 0.3 wt %. The manganese content is typically at most 0.6 wt % and preferably at most 0.5 wt %. In an embodiment of the invention the manganese content is at most 0.40 wt. %. The addition of manganese in these quantities may particularly improve balance between the properties sought in many embodiments.

The magnesium content is typically at least 0.2 wt % and preferably at least 0.30 wt %. The magnesium content is typically at most 0.6 wt % and preferably at most 0.50 wt %. In an embodiment of the invention the magnesium content is at most 0.40 wt. %. The silver content is at least 0.15 wt %. The silver content is at most 0.25 wt %. The present inventors have surprisingly found that the addition of more than 0.25% by weight silver could have an adverse effect on energy absorption during an impact in some embodiments. It is important in many embodiments to combine the silver content of 0.15% to 0.25% by weight to a controlled stretching with a permanent set of from 2 to 4%, in particular as a controlled stretching with a permanent set of less than 2% may not permit obtaining the desired mechanical strength. The addition of magnesium and silver is important in many embodiments to reach a favorable balance between static mechanics resistance, energy absorbed, density and toughness.

The zirconium content is generally at least 0.07 wt % and preferably at least 0.10 wt %. The zirconium content is generally at most 0.15 wt % and preferably at most 0.13 wt %. The addition of zirconium is notably important in many embodiments to preferably maintain an essentially unrecrystallized structure that is desired for the extruded products according to many embodiments of the present invention.

The titanium content lies typically from 0.01 wt % to 0.15 wt % and preferably from 0.02 wt % to 0.05 wt %. The addition of titanium notably makes it possible in many embodiments to obtain a controlled granular structure of the rough form obtained after the casting.

The quantity of Fe and Si is each generally not more than or equal to 0.1 wt %. Preferably the Fe and Si contents are each not more than 0.08 wt %.

The Zn content is typically not more than 0.2 wt %, preferably not more than 0.15 wt % and more preferably not more than 0.1 wt %. The presence of Zn may have an unfavorable effect on the balance between static mechanical strength, absorbed energy, density and toughness, notably as this element may adversely affect the density of the alloy without having a very favorable effect on the static mechanical resistance, absorbed energy and toughness.

The unavoidable impurities are generally maintained at less than or equal to 0.05 wt % each and 0.15 wt % in total.

The extruded products can suitably be prepared using a method in which a rough form is first cast in an alloy according to the invention. Preferably, the rough form is an extrusion billet. The rough form is then homogenized at a temperature of 490° C. to 520° C. for 8 to 48 hours. Homogenization may be performed in one or more stages. The rough form may be cooled to ambient temperature after homogenization or brought directly to the hot working temperature. The homogenized rough form is hot worked by extruding at an initial hot working temperature of 420° C. to 480° C. to obtain an extruded product. The extruding temperature used notably makes it possible to obtain the essentially unrecrystallized structure desired.

The extruded products according to the invention are preferably profiles for which the thickness of at least one of the elementary rectangles is between 1 mm and 30 mm, preferably between 2 mm and 20 mm and more preferably between 5 mm and 16 mm. The extruded products used in aeronautic construction generally comprise several segments or elementary rectangles of different thickness. A difficulty encountered with these products is to achieve satisfactory properties in the various segments. The alloy according to the invention notably makes it possible to obtain a favorable balance between static mechanical strength, absorbed energy, density and toughness for elementary rectangles of different thickness.

The extruded product thus obtained then undergoes solution heat treatment at a temperature of 500° C. to 520° C. for 15 minutes to 8 hours, then is quenched with water at ambient temperature. Quenching is preferably carried out in water, by spraying or immersion.

The solution heat treated and quenched extruded product then undergoes stretching with a permanent set of 2 wt % to 4 wt %. Permanent set by insufficient stretching, such as a permanent set of 1.5%, does not make it possible to reach the balance between the desired properties. A permanent set under excessive stretching, such as a 6 wt % set notably does not make it possible to guarantee the dimensional characteristics of the extruded product, typically regarding the angles between the various elementary rectangles.

It may be necessary to perform a straightening operation to obtain the desired dimensional properties.

The extruded product is aged by heating at a temperature of 100° C. to 170° C. for 5 to 100 hours. Aging may be performed in one or more stages. Preferably, the aging is performed in one stage at a temperature between 130° C. and 170° C. and advantageously between 150° C. and 160° C. for 20 to 40 hours.

The extruded products obtained are preferably an essentially unrecrystallized granular structure. Within the scope of this invention, an essentially unrecrystallized granular structure refers to a granular structure such that the recrystallization rate between ¼ and ½ thickness of an elementary rectangle is less than 30% and preferably less than 10%.

The extruded products according to the invention have particularly advantageous mechanical properties.

Thus, the extruded products according to the invention preferably have the following properties at mid-thickness:

for a thickness of between 5 mm and 16 mm an average tensile yield stress $R_{p0.2}$ in the L-direction of at least 630 MPa and preferably of at least 635 MPa and an average tensile yield stress $R_{p0.2}$ in the LT-direction of at least 625 MPa and preferably of at least 630 MPa and an EA factor $$EA=(R_m(L)+R_{p0.2}(L))/2*E\ \%\ (L)+(R_m(LT)+R_{p0.2}(LT))/2*E\ \%\ (LT)$$

at least equal to 14,000 and preferably at least equal to 14,500 and/or for a thickness between 17 mm and 30 mm, an average tensile yield stress Rp0.2 in the L-direction of at least 655 MPa and preferably at least 660 MPa and an average tensile yield stress Rp0.2 in the LT-direction of at least 600 MPa and preferably of at least 605 MPa and an EA factor $$EA=(R_m(L)+R_{p0.2}(L))/2*E\ \%\ (L)+(R_m(LT)+R_{p0.2}(LT))/2*E\ \%\ (LT)$$

at least equal to 9,500 and preferably at least equal to 9,800.

In addition, the products according to the invention have advantageous toughness.

Thus, the products according to the invention preferably have thickness between 5 mm and 16 mm, a toughness $K_{1C}$(L−T), of at least 24 MPa $\sqrt{m}$ and preferably of at least 25 MPa $\sqrt{m}$ and a thickness between 17 mm and 30 mm a toughness $K_{1C}$(L−T), of at least 21 MPa $\sqrt{m}$ and preferably of at least 22 MPa $\sqrt{m}$.

Finally, the products according to the invention have excellent corrosion resistance. Thus, the extruded products according to the invention have a resistance of at least 30 days during a stress corrosion test as per standards ASTM G44 and ASTM G49 on test specimens taken in the LT-direction for a stress of 450 MPa.

The extruded products according to the invention are particularly advantageous for aeronautic construction. Thus, the products according to the invention are used in aeronautic construction as a fuselage stiffener or stringer, circumferential frame, wing stiffener, floor beam or profile, or seat track. In a preferred embodiment, the products according to the invention are used as a floor beam, notably as a beam of the lower floor of aircraft, or cargo floor, this floor being particularly important during an impact.

Example 1

In this example, five alloys, the composition of which is given in Table 1, were prepared and cast in rough form.

TABLE 1

| Composition in wt % of the alloys | | | | | | | | | |
|---|---|---|---|---|---|---|---|---|---|
| | Cu | Li | Mn | Mg | Zr | Ag | Ti | Si | Fe |
| A (inv) | 4.52 | 1.02 | 0.37 | 0.35 | 0.11 | 0.21 | 0.03 | 0.05 | 0.05 |
| B (ref) | 4.36 | 1.13 | 0.01 | 0.35 | 0.13 | 0.33 | 0.05 | 0.03 | 0.01 |
| C (ref) | 4.30 | 1.17 | 0.31 | 0.39 | 0.12 | 0.35 | 0.02 | 0.06 | 0.03 |
| D (ref) | 4.10 | 0.98 | 0.00 | 0.35 | 0.12 | 0.35 | 0.02 | 0.04 | 0.03 |
| E (ref) | 4.16 | 1.02 | 0.00 | 0.36 | 0.14 | 0.29 | 0.03 | 0.05 | 0.03 |

inv: invention - ref: reference

The rough forms were homogenized at a temperature of 490° C. to 520° C. adapted according to their composition, extruded in the form of extruded product described in FIG. 1, for which the thickness of the elementary rectangles is between 17 mm and 22 mm, with an initial hot working temperature of approximately 460° C. The extruded products obtained were solution heat treated at a temperature adapted to the alloy between 500° C. and 520° C., quenched, stretched approximately 3 wt % and aged 30 hours at 155° C.

The mechanical properties obtained for cylindrical samples measuring 10 mm in diameter taken at mid-thickness and quarter-width in the flange of thickness 18 mm of the extruded products are presented in Table 2. In order to evaluate the energy absorption during an impact, the following parameter was calculated $$EA=(R_m(L)+R_{p0.2}(L))/2*E\ \%\ (L)+(R_m(LT)+R_{p0.2}(LT))/2*E\ \%\ (LT)$$

The structure of the extruded product obtained was essentially unrecrystallized. The recrystallized granular structure content between ¼ and ½ thickness was less than 10 wt %.

TABLE 2

Mechanical properties obtained for the various alloys.

| | Alloy | | | | |
|---|---|---|---|---|---|
| | A | B | C | D | E |
| Rm L (MPa) | 679 | 667 | 668 | 648 | 664 |
| Rp0.2 L (MPa) | 663 | 650 | 653 | 629 | 645 |
| E % L | 8.1 | 10.4 | 8.0 | 9.3 | 10.1 |
| Rm LT (MPa) | 641 | 635 | 619 | 601 | 622 |
| Rp02 LT (MPa) | 608 | 599 | 590 | 569 | 596 |
| E % LT | 7.2 | 6.2 | 5.1 | 5.3 | 5.9 |
| $K_{1C}$ L-T (MPa $m^{1/2}$) | 22.5 | 22.8 | 21.4 | 28.6 | 23.9 |
| $K_{1C}$ T-L (MPa $m^{1/2}$) | 18.8 | 18.3 | 19.5 | 22.7 | 19.0 |
| EA | 9,896 | 10,635 | 8,331 | 9,033 | 10,204 |

Figure 2:
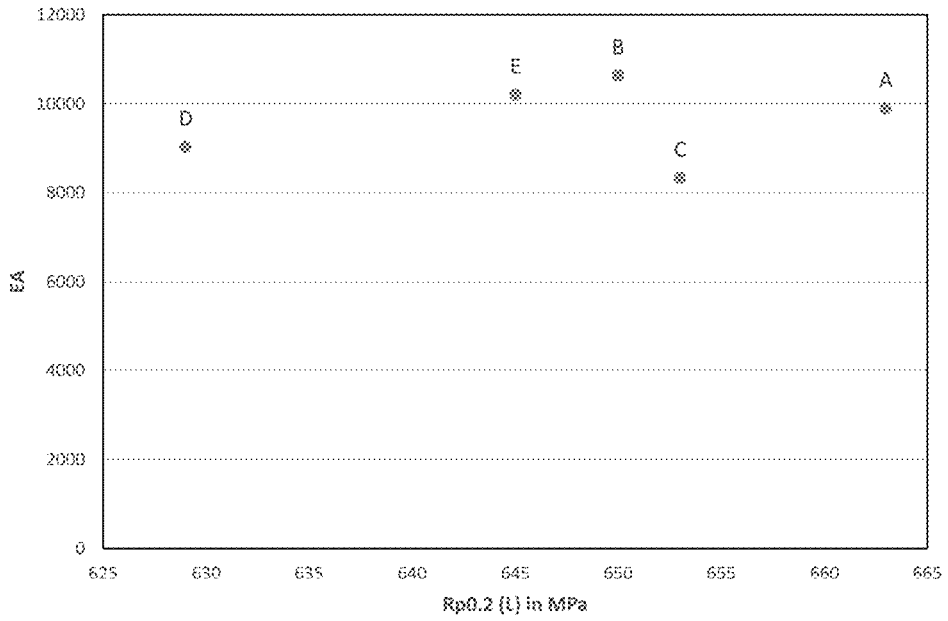
FIG. 2: Balance between the tensile yield stress and the EA parameter for the extruded products of example 1.

FIG. 2 presents the balance between tensile yield stress and the EA parameter. The alloy according to the invention makes it possible to reach a particularly advantageous balance.

The extruded product made of alloy A according to the invention underwent a stress corrosion test as per standards ASTM G44 and ASTM G49 for a stress of 450 MPa on test specimens taken in the LT-direction. No failure was observed after 30 days of testing.

Example 2

In this example, the alloys A and B presented in Example 1 were extruded in the form of an extruded product of a different shape and having thinner elementary rectangle thicknesses, between 5 mm and 12 mm. The rough shapes were homogenized for 15 hours at 500° C., then 20 to 25 hours at 510° C., extruded in an I-shaped extruded product with an initial hot working temperature of approximately 460° C. The extruded products obtained were solution heat treated at approximately 510° C., quenched, stretched approximately 3.5 wt % and aged 30 hours at 155° C.

The mechanical properties in the longitudinal direction were measured on "full thickness" test specimens taken in the various elementary rectangles of the extruded product (thicknesses 5, 7 and 12 mm) and averaged for the various profiles obtained. The "full thickness" measurement underestimates the actual value measured at mid-thickness on machined test specimens owing to the effect of the different microstructure near the surface.

A correction factor was introduced to take this means into account, however the factor was selected so that the actual value on the machined test specimen would undoubtedly be greater than the corrected value indicated. The mechanical properties in the cross-wise direction were measured on machined test specimens taken in the area of thinnest thickness, the only zone possible for this type of measurement due to the length of the test specimens required for this measurement. The toughness properties were measured on test specimens taken in the zone of greatest thickness.

The structure of the extruded product obtained was essentially unrecrystallized. The recrystallized granular structure content between ¼ and ½ thickness was less than 10 wt %.

The mechanical properties thus obtained are presented in Table 3.

TABLE 3

Mechanical properties obtained for the various alloys.

| | Alloy | |
|---|---|---|
| | A | B |
| Rm L* | 661 | 651 |
| Rp0.2 L* | 639 | 627 |
| E % L | 10.8 | 9.8 |
| Rm LT | 664 | 663 |
| Rp02 LT | 633 | 622 |
| E % LT | 11.6 | 11.8 |
| $K_{1C}$ L-T | 25.3 | 22.9 |
| $K_{1C}$ T-L | 23.7 | 19.4 |
| EA | 14,540 | 13,840 |

*correction factor 1.033 applied to the result obtained on a full-thickness test specimen Again, the extruded product according to the invention reaches a more favorable balance than the reference extruded product between the mechanical strength and the parameter EA.

The invention claimed is:

1. An extruded product of an aluminum alloy consisting of:

from 4.2 weight % to 4.8 weight % of Cu,
from 0.9 weight % to 1.1 weight % of Li,
from 0.15 weight % to 0.25 weight % of Ag,
from 0.2 weight % to 0.6 weight % of Mg,
from 0.07 weight % to 0.15 weight % of Zr,
from 0.2 weight % to 0.6 weight % of Mn,
from 0.01 weight % to 0.15 weight % of Ti, and
a quantity of Zn less than 0.1 weight %,
a quantity of Fe and Si each less than or equal to 0.1 weight %,
inevitable impurities wherein each of the inevitable impurities has a content less than or equal to 0.05 weight % and the inevitable impurities in total has a content less than or equal to 0.15 weight %,
and the remainder being aluminum;
wherein
(1) for a thickness of from 5 mm to 16 mm, the extruded product at mid-thickness has an average tensile yield stress Rp0.2 in an L-direction of at least 630 MPa, an average tensile yield stress Rp0.2 in an LT-direction of at least 625 MPa, and an EA factor, EA, of at least equal to 14,000,
and/or
(2) for a thickness from 17 mm to 30 mm, the extruded product at mid-thickness has an average tensile yield stress Rp0.2 in an L-direction of at least 655 MPa, an average tensile yield stress Rp0.2 in an LT-direction of at least 600 MPa, and an EA factor, EA, of at least equal to 9,500;
wherein the EA factor, EA, in (1) and (2) above, is calculated via the following formulaic expression, $$EA=(R_m(L)+R_p0.2(L))/2*E\ \%\ (L)+(R_m(LT)+R_p0.2(LT))/2*E\ \%\ (LT)$$

wherein
$R_m$(L) represents an ultimate tensile strength in an L-direction,
$R_m$(L) represents an ultimate tensile strength in an LT-direction,
$R_p$0.2(L) represents an average tensile yield stress in an L-direction,
$R_p$0.2(LT) represents an average tensile yield stress in an LT-direction, E % (L) represents an elongation at break in an L-direction, and E % (LT) represents an elongation at break in an LT-direction.

2. The extruded product according to claim 1, wherein the Cu is from 4.3 weight % to 4.7 weight %.

3. The extruded product according to claim 1, wherein the Cu is from 4.35 weight % to 4.55 weight %.

4. The extruded product according to claim 1, wherein the Cu is from 4.5 weight % to 4.7 weight %.

5. The extruded product according to claim 1, wherein the Li is from 0.95 weight % to 1.05 weight %.

6. The extruded product according to claim 1, wherein the Mg is from 0.30 weight % to 0.50 weight % and/or the Zr is from 0.10 weight % to 0.13 weight %.

7. The extruded product according to claim 1, wherein the Mn is from 0.3 weight % to 0.5 weight %.

8. The extruded product according to claim 1, wherein a recrystallization rate from ¼ to ½ thickness of an elementary rectangle is not more than 30%.

9. The extruded product according to claim 1, wherein a recrystallization rate from ¼ to ½ thickness of an elementary rectangle is not more than 10%.

10. The extruded product according to claim 1, wherein (1) for a thickness of from 5 mm to 16 mm, the extruded product at mid-thickness has an average tensile yield stress Rp0.2 in an L-direction of at least 635 MPa, an average tensile yield stress Rp0.2 in an LT-direction of at least 630 MPa, and an EA factor, EA, of at least equal to 14,500, and/or (2) for a thickness from 17 mm to 30 mm, the extruded product at mid-thickness has an average tensile yield stress Rp0.2 in an L-direction of at least 660 MPa, an average tensile yield stress Rp0.2 in an LT-direction of at least 605 MPa, and an EA factor, EA, of at least equal to 9,800.

11. The extruded product according to claim 1, wherein (1) for a thickness of from 5 mm to 16 mm, the extruded product has a toughness, $K_{1C}$L–T), of at least 24 MPa $\sqrt{m}$, or (2) for a thickness from 17 mm to 30 mm, the extruded product has a toughness, $K_{1C}$(L–T), of at least 21 MPa $\sqrt{m}$.

12. The extruded product according to claim 1, wherein (1) for a thickness of from 5 mm to 16 mm, the extruded product has a toughness, $K_{1C}$(L–T), of at least 25 MPa $\sqrt{m}$, or (2) for a thickness from 17 mm to 30 mm, the extruded product has a toughness, $K_{1C}$(L–T), of at least 22 MPa $\sqrt{m}$.

13. The extruded product according to claim 1, wherein the product has a resistance of at least 30 days during a stress corrosion test as per standards ASTM G44 and ASTM G49 on test specimens taken in the LT-direction for a stress of 450 MPa.

14. The extruded product according to claim 1, wherein the extruded product is capable of being used for aeronautic construction as a fuselage stiffener or stringer, circumferential frame, wing stiffener, floor profile or beam or seat track.

15. An aeronautic construction product comprising the extruded product of claim 1, wherein said aeronautic construction product optionally comprises a fuselage stiffener, stringer, circumferential frame, wing stiffener, floor profile, beam and/or seat track.

16. A process for manufacturing an extruded product according to claim 1, comprising:

(a) casting a rough alloy form with a composition of the aluminum alloy of claim 1, (b) homogenizing said rough alloy form at a temperature of 490° C. to 520° C. for 8 to 48 hours, (c) hot working by extrusion at an initial hot working temperature of 420° C. to 480° C., (d) undergoing solution heat treatment at a temperature of 500° C. to 520° C. for 15 minutes to 8 hours, (e) quenching, (f) undergoing controlled stretching with a permanent set from 2 weight % to 4 weight %, (g) optionally, straightening, (h) aging by heating at a temperature of 100° C. to 170° C. for 5 to 100 hours to result in the extruded product of claim 1.

* * * * *